US006557863B2

(12) United States Patent
Chen

(10) Patent No.: US 6,557,863 B2
(45) Date of Patent: May 6, 2003

(54) SKATE BODY

(75) Inventor: Lung-Chuan Chen, Taichung Hsien (TW)

(73) Assignee: Angel Lime Plastic Co., Ltd., Taichung Hsien (TW)

( * ) Notice: Subject to any disclaimer, the term of this patent is extended or adjusted under 35 U.S.C. 154(b) by 0 days.

(21) Appl. No.: 09/843,189

(22) Filed: Apr. 26, 2001

(65) Prior Publication Data

US 2002/0079657 A1 Jun. 27, 2002

(51) Int. Cl.[7] ..... A63C 17/06; A63C 17/14

(52) U.S. Cl. ..... 280/11.208; 280/11.231; 280/11.221; 280/11.204; 280/11.27

(58) Field of Search ..... 280/11.204, 11.206, 280/11.207, 11.208, 11.216, 11.221, 11.27, 11.231

(56) References Cited

U.S. PATENT DOCUMENTS 5,067,736 A * 11/1991 Olson et al. ..... 280/11.22
5,253,883 A * 10/1993 Moldenhauer ..... 280/11.22
5,257,795 A * 11/1993 Babcock ..... 280/11.22
5,348,320 A * 9/1994 Gay ..... 280/11.22
5,470,085 A * 11/1995 Meibock et al. ..... 280/11.22
5,482,301 A * 1/1996 Babcock ..... 280/11.22
5,645,287 A * 7/1997 Soo ..... 280/11.22
5,741,017 A * 4/1998 Chen ..... 280/11.22
5,979,916 A * 11/1999 Gatel et al. ..... 280/11.22
6,176,497 B1 * 1/2001 Bonaventure ..... 280/11.27

* cited by examiner

*Primary Examiner*—Brian L. Johnson
*Assistant Examiner*—Jeffrey J. Restifo
(74) *Attorney, Agent, or Firm*—Alan Kamrath; Rider, Bennett, Egan & Arundel, LLP

(57) ABSTRACT

A skate body having a first body portion and a second body portion that are releasably secured together. A brake device includes a brake seat mounted to one of the first and second body portions and a brake block. The brake seat includes a resilient hook member and a rib formed on an inner wall thereof. The brake block includes an engaging groove releasably engaged with the rib of the brake seat and a retaining piece releasably engaged with the resilient hook member of the brake seat.

19 Claims, 7 Drawing Sheets

SKATE BODY

BACKGROUND OF THE INVENTION

1. Field of the Invention

The present invention relates to an improved skate body with an easy-to-replace brake block.

2. Description of the Related Art

FIG. 7 of the drawings illustrates a conventional skate body 1 that is integrally formed and has a single color, which cannot attract buyers. A brake block 3 is attached by a bolt 2 and a nut 5 to a brake seat 4 located on a front end of the skate body 1. It was found that the bolt and nut engagement tends to loosen and/or rust after a period of time, which may lead to an accident.

It is the primary object of the present invention to provide an improved skate body that includes two body portions for providing a variety of combinations in colors and configurations. In addition, the skate body includes a brake block that can be removed easily and quickly when it is worn out, and a new one can be attached to the skate body easily and quickly.

SUMMARY OF THE INVENTION

A skate body in accordance with the present invention comprises a brake device mounted to a front end of the skate body. The skate body comprises a first body portion and a second body portion that are releasably secured together. The brake device includes a brake seat mounted to one of the first and second body portions and a brake block. The brake seat includes a resilient hook member and a rib formed on an inner wall thereof. The brake block includes an engaging groove releasably engaged with the rib of the brake seat and a retaining piece releasably engaged with the resilient hook member of the brake seat.

One of the first and second body portions includes a slot, and the brake seat includes an engaging piece for releasably engaging with the slot. The first body portion includes two lateral sides having a space therebetween. The first body portion further includes two ends each having a connecting portion formed thereon. Each connecting portion includes an opening, and the slot is defined in one of the connecting portions. The second body portion includes two lateral sides having a space in the front ends thereof for engaging with a portion of the brake seat. The second body portion includes two ends each having an inverted U-shape connecting portion formed thereon. Each connecting portion of the second body portion is integrally formed with an associated lateral side. An upper portion of each connecting portion is engaged in the opening of an associated connecting portion of the first body portion. Each connecting portion of the second body portion has a hole for connection with a boot. Each connecting portion of the first body portion has a plurality of holes for connection with a boot. The brake seat includes a slot that communicates, an interior of the brake seat with outside.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
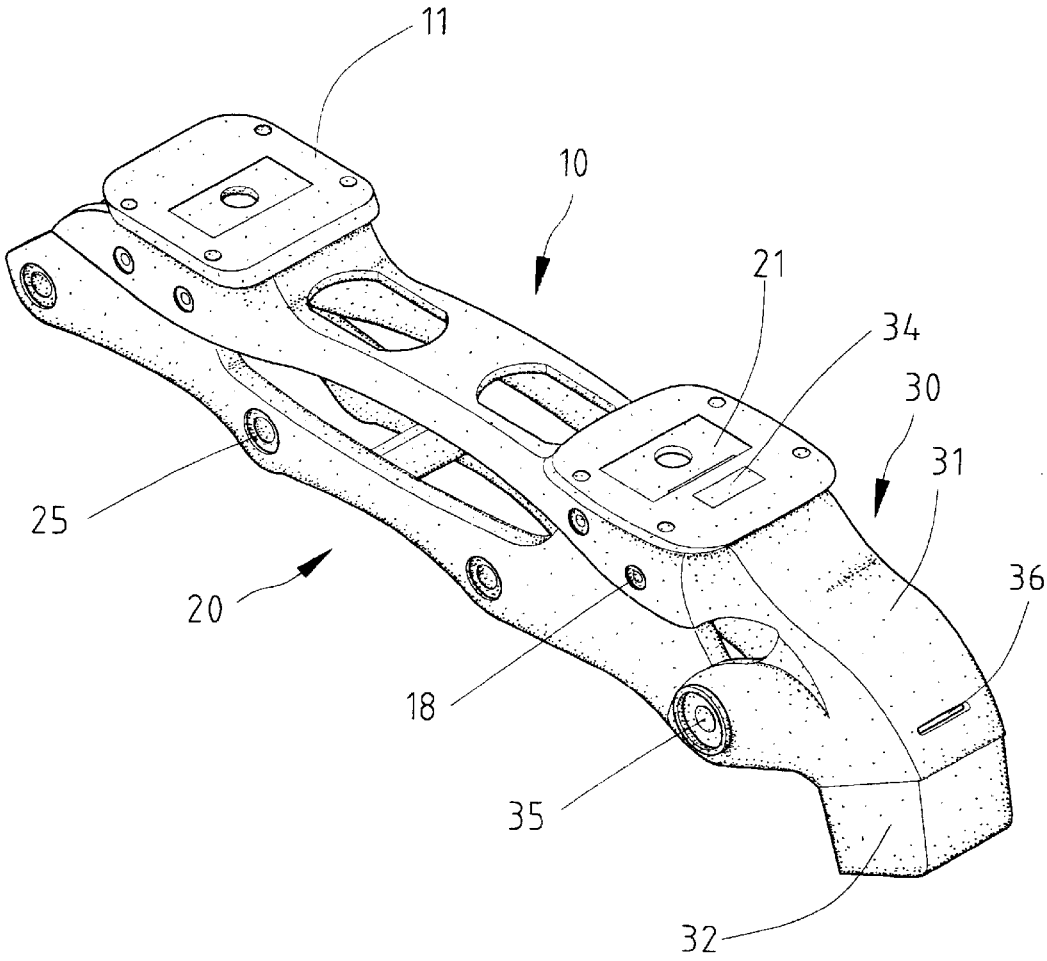
FIG. 1 is a perspective view of a skate body in accordance with the present invention.
Figure 2:
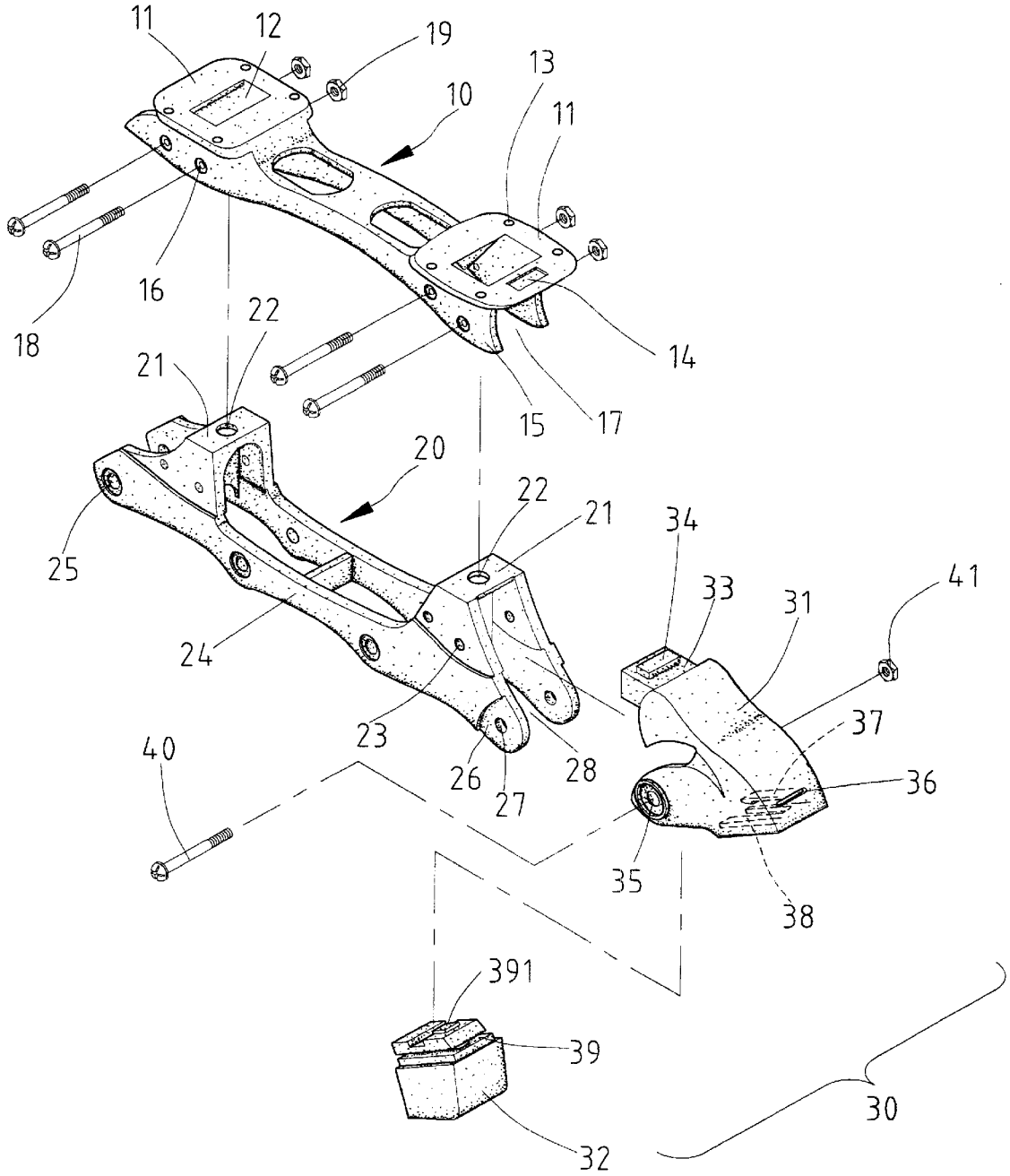
FIG. 2 is an exploded perspective view of the skate body in accordance with the present invention.

Referring to FIGS. 1 and 2, a skate body in accordance with the present invention generally includes a first body portion 10, a second body portion 20, and a brake means 30. The first body portion 10 is substantially U-shape and includes two lateral sides 15 and two ends each having a connecting portion 11 formed thereon. Each connecting portion 11 includes an opening 12 in a center thereof. A plurality of holes 13 are defined in the connecting portion 11 for connection with a boot 62 (FIG. 5) or the like. A slot 14 is defined in one of the connecting portions 11. The lateral sides 15 of the first body portion 10 include a plurality of aligned holes 16, which will be described later. A space 17 is defined between the lateral sides 15.

Figure 5:
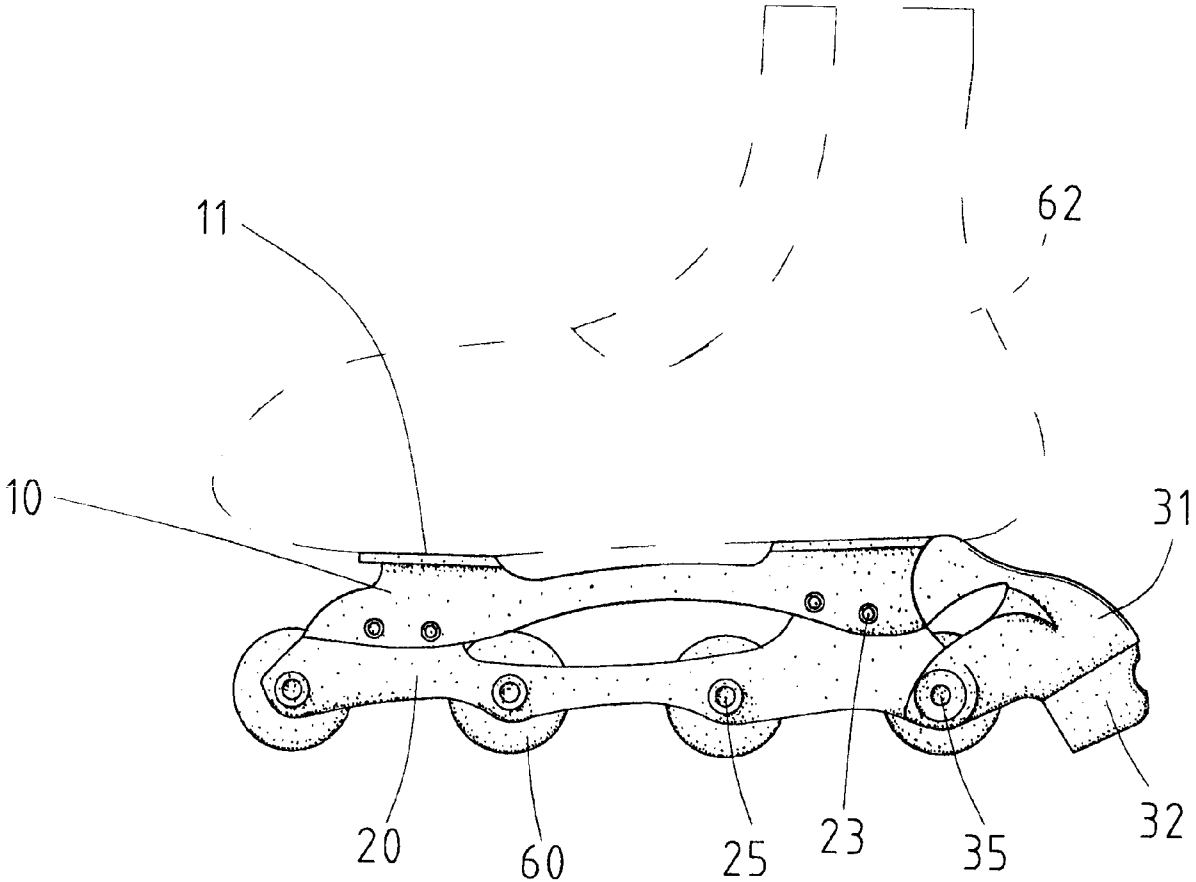
FIG. 5 is a side view of a roller skate with the skate body in FIG. 1.

The second body portion 20 is substantially U-shape and includes two lateral sides 24 and two ends each having an inverted U-shape connecting portion 21 formed thereon, wherein each of two limbs (not labeled) of the connecting portion 21 is integrally formed with an associated lateral side 24. The lateral sides 24 include a space 28 therebetween and a plurality of pairs of aligned holes 25 for mounting wheels 60 (FIG. 5). The lateral sides 24 further include a pair of aligned holes 27 in front ends 26 thereof. Each connecting portion 21 includes a hole 22 for connection with the boot 62 (FIG. 5).

Figure 3:
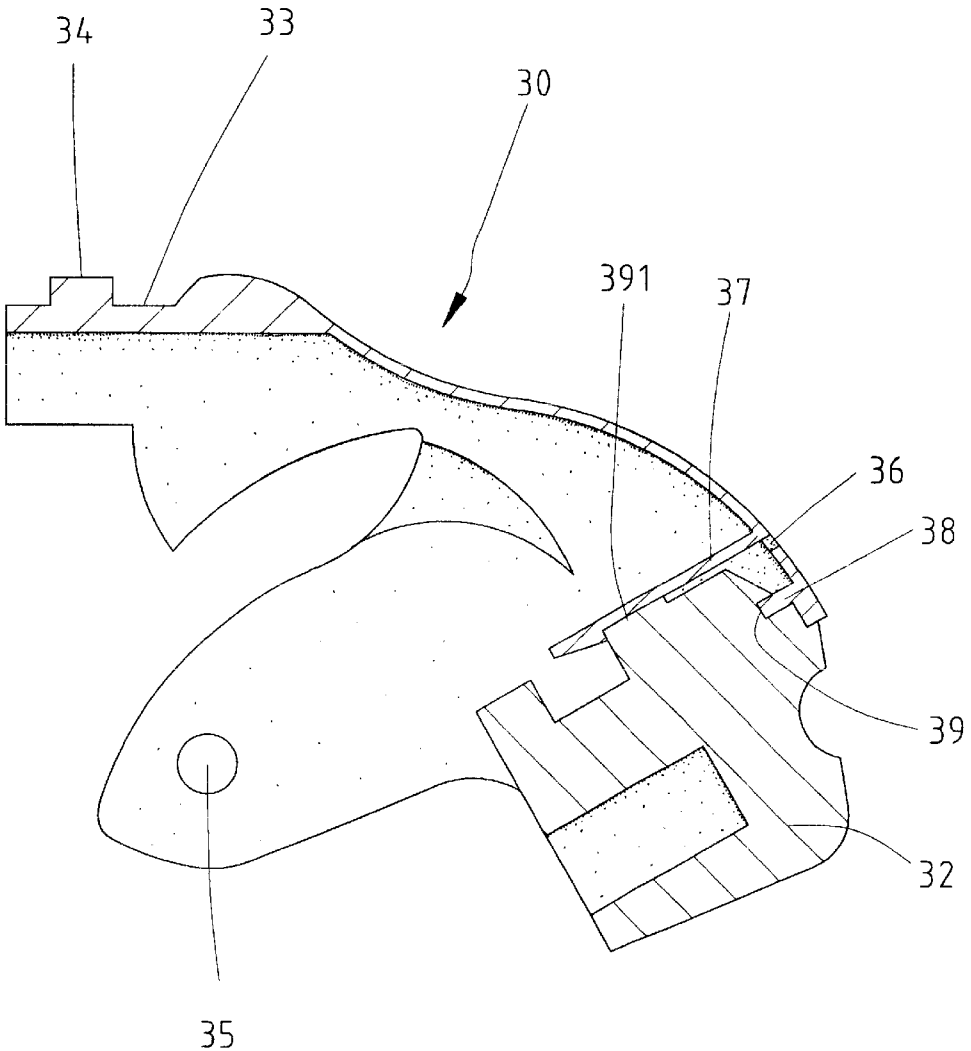
FIG. 3 is a sectional view, in an enlarged scale, of a front portion of the skate body in accordance with the present invention.

The brake means 30 includes a brake seat 31 that is mounted to the front end of the second body portion 20 by a screw 40 that extends through a transverse hole 35 in the brake seat 31 and engages with a nut 41. The brake seat 31 includes an engaging portion 33 with an engaging piece 34 for releasably engaging with the slot 14 in the first body portion 10. The brake seat 31 further includes a resilient hook member 37 and a substantially U-shape rib 38 formed on an inner wall thereof. The brake seat 31 further includes a slot 36 that communicates an interior of the brake seat 31 with outside, as best shown in FIG. 3.

The brake means 30 further includes a brake block 32 releasably attached to the brake seat 31. The brake block 32 includes an engaging groove 39 for releasable engagement with the rib 38 of the brake seat 31. The brake block 32 further includes a retaining piece 391 for releasable engagement with the resilient hook member 37 of the brake seat 31, as best shown in FIG. 3.

In assembly, the second body portion 20 is inserted into the space 17 of the first body portion 10 with the holes 16 in the first body portion 10 aligned with holes 23 in the second body portion 20 and with an upper portion of each connecting portion 21 of the second body portion 20 engaged in the opening 12 of an associated connecting portion 11 of the first body portion 10. Screws 18 are extended through the holes 16 and 23 and engaged with nuts 19 to thereby secure the first and second body portions 10 and 20 together. The brake seat 31 is attached to the front end of the second body portion 20 by the screw 40 with the engaging piece 34 engaged with the slot 14 of the first body portion 10. The brake block 32 is inserted into an interior of the brake seat 31 with the engaging groove 39 engaged with the rib 38 of the brake seat 31 and with the retaining piece 391 engaged with the resilient hook member 37 of the brake seat 31, as best shown in FIG. 3.

Figure 4:
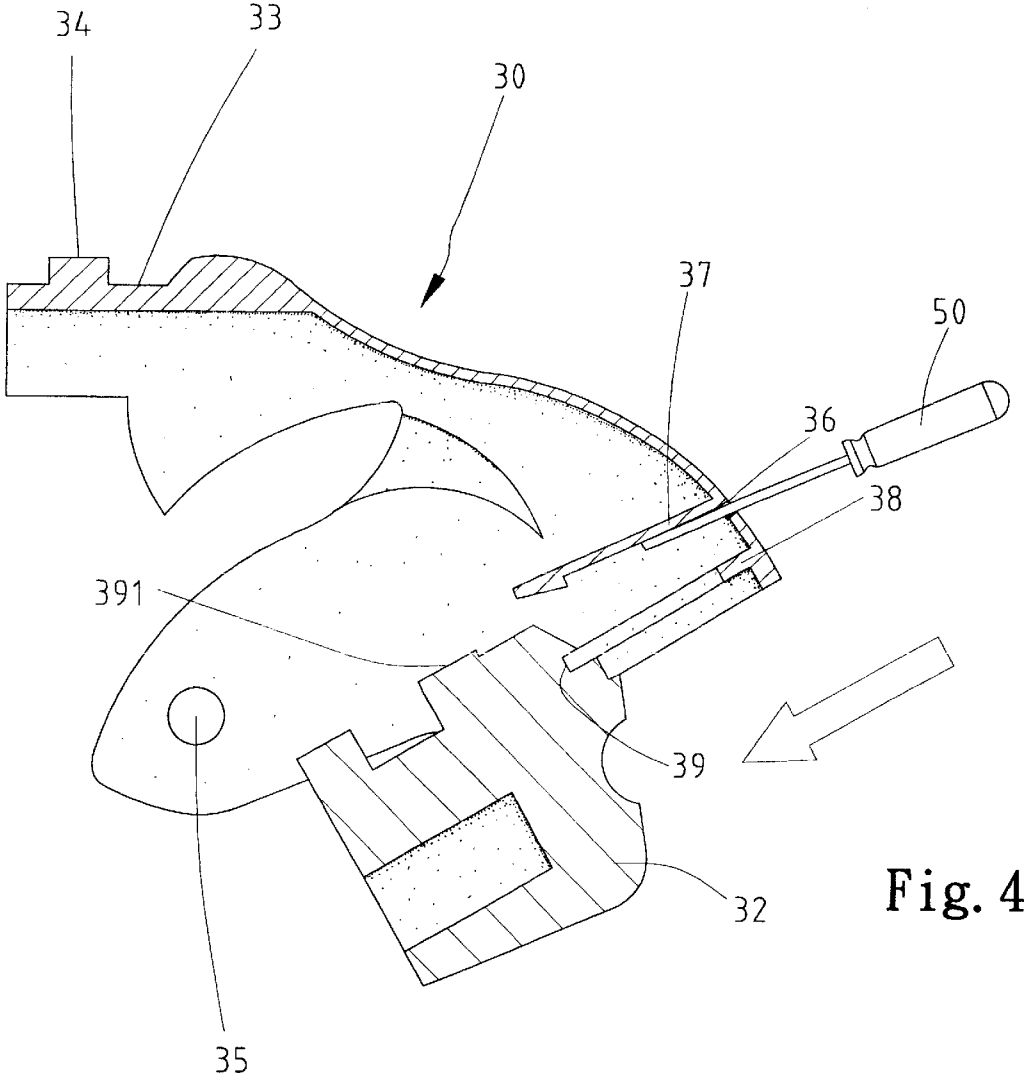
FIG. 4 is a sectional view similar to FIG. 3, illustrating removal of a brake block.

Referring to FIG. 4, when the brake block 32 is worn out, the user may extend a tool (such as a screwdriver 50) through the slot 36 into the interior of the brake seat 31 until the blade of the screwdriver 50 is in contact with the resilient hook member 37. Then, the user applies a force to the handle of the screwdriver 50 to move the resilient hook member 37 away from the brake block 32. The engaging piece 391 of the brake block 32 will be disengaged from the resilient hook member 37, and the engaging groove 39 will be disengaged from the rib 38 of the brake seat 31. Thus, the brake block 32 is removed, and a new one can be mounted to the brake seat 31 subsequently.

Figure 6:
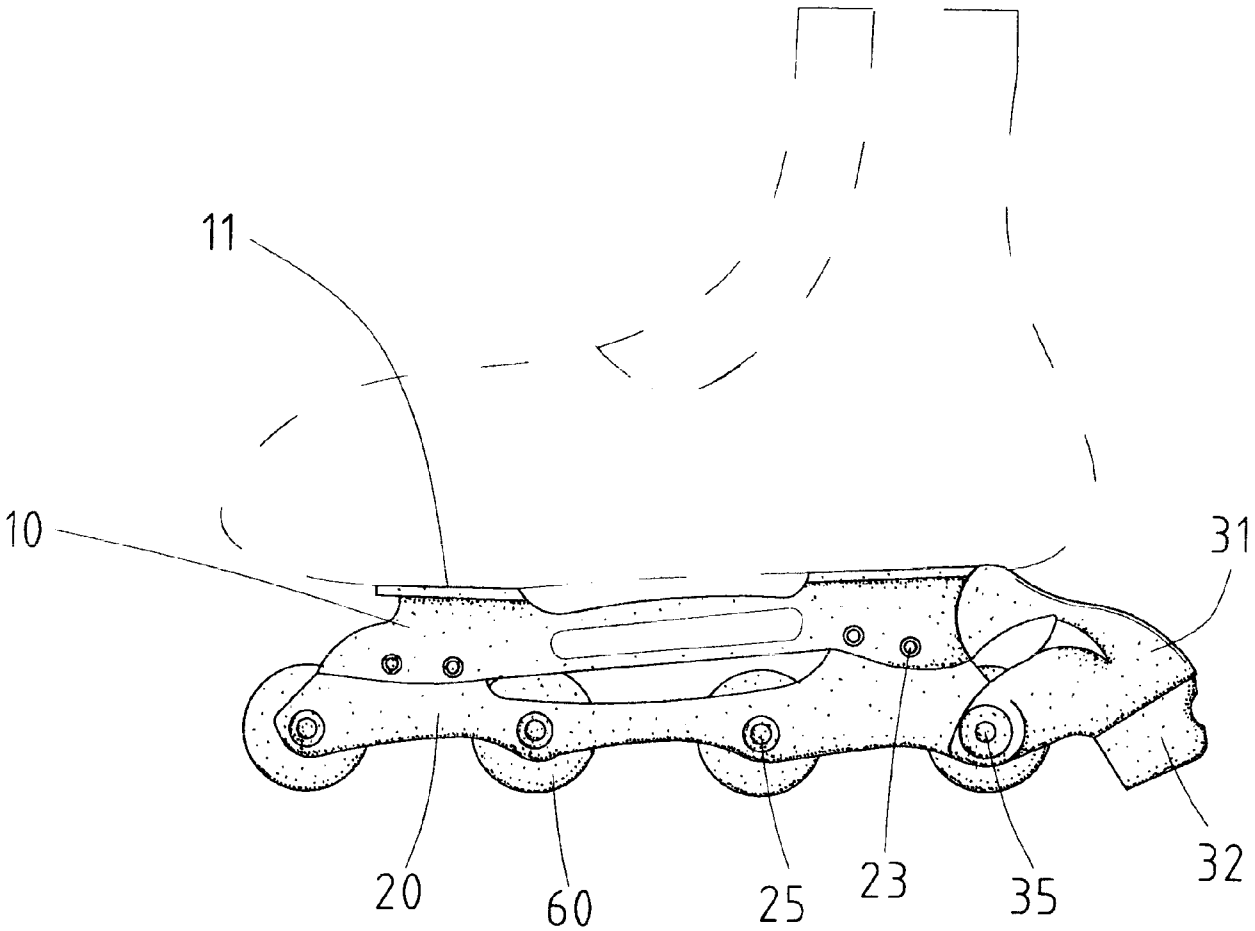
FIG. 6 is a side view similar to FIG. 5, illustrating a skate body with a different configuration.
Figure 7:
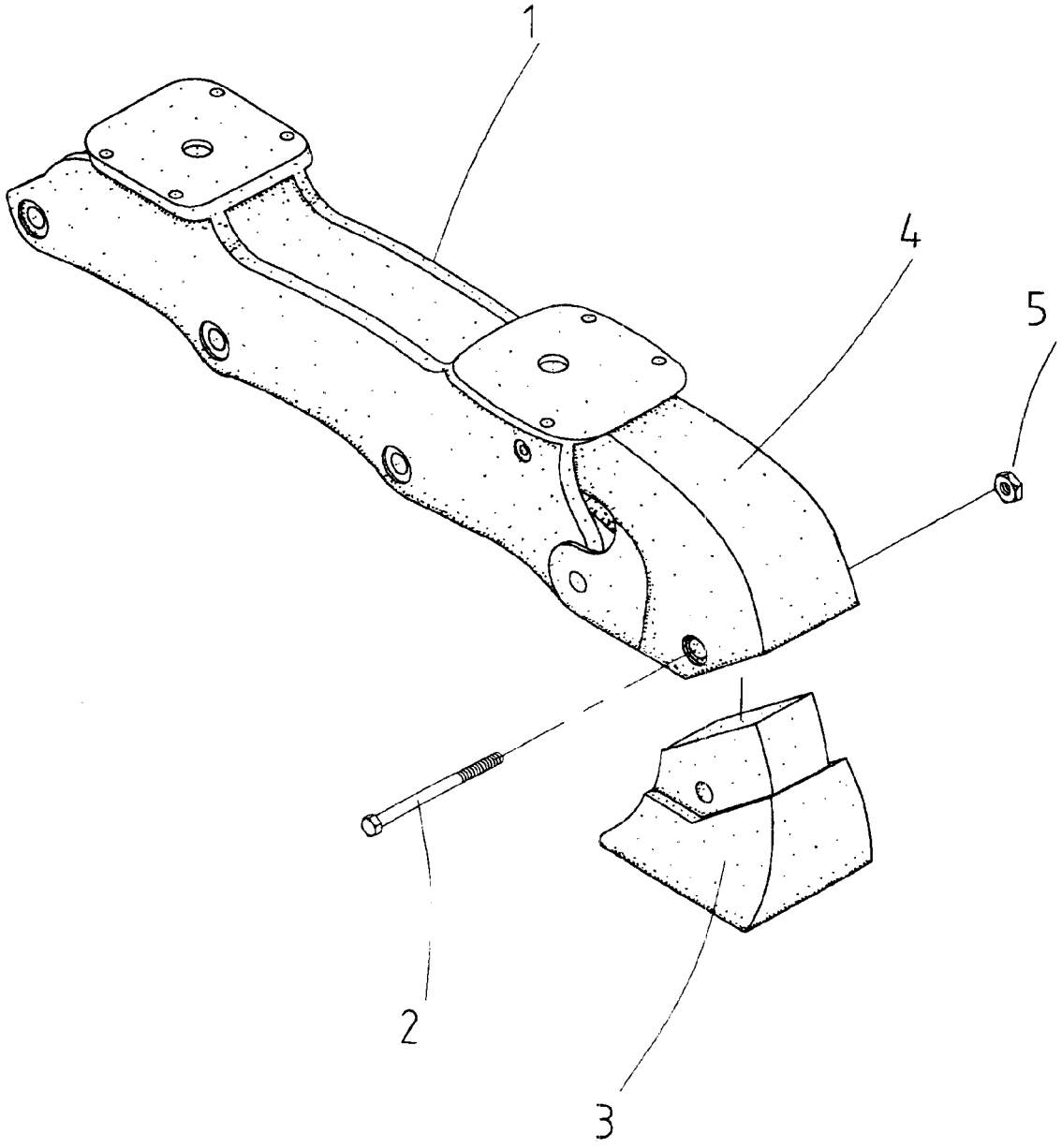
PRIOR ART Fig. 7
FIG. 7 is a perspective view of a prior art skate body.

Configurations of both of the first and second body portions 10 and 20 can be modified according to the market need. FIGS. 5 and 6 illustrate skate bodies having slight differences in middle areas of the first body portions 10.

Although the invention has been explained in relation to its preferred embodiment, it is to be understood that many other possible modifications and variations can be made without departing from the scope of the invention as hereinafter claimed.

What is claimed is:

1. A skate body comprising:

a first body portion and a second body portion that are releasably secured together, wherein the first body portion is of a substantially U-shape and includes two lateral sides having a space therebetween, the first body portion further includes two ends each having a connecting portion Conned thereon, each said connecting portion includes an opening, with the connection portions of the two ends and the two lateral sides being of a single piece, wherein the second body portion includes two lateral sides and two ends each having an inverted U-shape connecting portion formed thereon, each said connecting portion of the second body portion is integrally formed with an associated said lateral side, wherein an upper portion of each said connecting portion is engaged in the opening of an associated connecting portion of the first body portion, wherein each said connecting portion of the second body portion has a hole for receipt of a bolt in connection with a boot;

a brake seat mounted to one of the first and second body portions; and a brake block releasably engaged with the brake seat, with one of the brake seat and the brake block including a rib having first and second, spaced rib portions and the other of the brake seat and the brake block including an engaging groove having first and second, spaced groove portions for receiving the first arid second rib portions, wit the brake block being slideably received in the brake seat for slideable movement in a single plane by the rib and the engaging groove, with the brake seat including an abutment which prevents movement of the brake block in an insertion direction in the single plane, with the brake seat including a resilient hook for engaging with the brake block which prevents movement of the brake block in a removal direction in the single plane opposite to the insertion direction.

2. The skate body as claimed in claim 1, wherein one of the first and second body portions includes a slot, and the brake seat includes an engaging piece for releasably engaging with the slot.

3. The skate body as claimed in claim 2, wherein the slot is defined in one of the connecting portions.

4. The skate body as claimed in claim 3, wherein the two lateral sides of the second body portion have a space in front ends thereof for engaging with a portion of the brake seat.

5. The skate body as claimed in claim 3, wherein each said connecting portion of the first body portion has a plurality of holes for connection with a boot.

6. The skate body as claimed in claim 1, wherein the brake seat includes a slot that communicates an interior of the brake seat with outside and through which a tool can be extended in the removal direction for contacting and disengaging the resilient hook.

7. The skate body as claimed in claim 6, with the brake block including a retaining piece, with the resilient hook abutting the retaining piece when engaging with the brake block to define a channel between the resilient hook and a portion of the brake block for receiving the tool extended through the slot.

8. The skate body as claimed in claim 7, with the rib including a third rib portion extending between the first and second rib portions, with the rib being of a U-shape, with the engaging grove including a third groove portion for receiving the third rib portion.

9. The skate body as claimed in claim 8, with the brake block including a surface for abutting with the abutment of the brake seat and an opposite surface, with the brake block including a face having a depression for receiving a head of the resilient hook, with the retaining piece integrally extending from the face opposite to depression, with the depression located in the removal direction from the retaining piece.

10. The skate body as claimed in claim 1, with the rib including a third rib portion extending between the first and second rib portions, with the rib being of a U-shape, with the engaging groove including a third groove portion for receiving the third rib portion.

11. The skate body as claimed in claim 1, further comprising:

a plurality of holes formed in the two lateral sides of the first body portion;

a plurality of holes formed in the two lateral sides of the second body portion; and a plurality of bolts extended through the plurality of holes.

12. The skate body as claimed in claim 1, wherein each said connecting portion of the first body portion has a plurality of holes for connection with a boot.

13. A brake for a skate body, comprising:

a brake seat adapted to be mounted to the skate body; and a brake block, with one of the brake seat and the brake block including a rib having first and second, spaced rib portions and the other of the brake seat and the brake block including an engaging groove having first and second, spaced groove portions for receiving the first and second rib portions, with the brake block being slideably received in the brake seat for slideable movement in a single plane by the rib and the engaging groove, with the brake seat including an abutment which prevents movement of the brake block in an insertion direction in the single plane, with the brake seat including a resilient hook for engaging with the brake block which prevents movement of the brake block in a removal direction in the single plane opposite to the insertion direction.

14. The brake as claimed in claim 13, with the brake seat including a slot through which a tool can be extended in the removal direction for contacting and disengaging the insertion direction.

15. The brake as claimed in claim 14, with the brake block including a retaining piece, with the resilient hook abutting the retaining piece when engaging with the brake block to define a channel between the resilient hook and a portion of the brake block for receiving the tool extended through the slot.

16. The brake as claimed in claim 15, the rib including a third rib portion extending between the first and second rib portions, with the rib being of a U-shape, with the engaging groove including a third groove for receiving the third rib portion.

17. The brake as claimed in claim 16, with the brake block including a surface for abutting with the abutment of the brake seat and an opposite surface, with the brake block including a face having a depression for receiving a head of the resilient hook, with the retaining piece integrally extending from the face opposite to the depression, with the depression located in the removal direction from the retaining piece.

18. The brake as claimed in claim 15, the brake block including a surface for abutting with the abutment of the brake seat and an opposite surface, with the brake block including a face having a depression for receiving a head of the resilient hook, with the retaining piece integrally extending from the face opposite to the depression, with the depression located in the removal direction from the retaining piece.

19. The brake as claimed in claim 13, with the rib including a third rib portion extending between the first and second rib portions, with the rib being of a U-shape, with the engaging groove including a third groove portion for receiving the third rib portion.

* * * * *